US008250792B2

(12) United States Patent
Zhu

(10) Patent No.: US 8,250,792 B2
(45) Date of Patent: Aug. 28, 2012

(54) ELECTRIC FRAME FIREPLACE WITH AN INTERNAL CHARCOAL BED AND AN EXTERNAL CHARCOAL BED

(75) Inventor: Hongfeng Zhu, Almelo (CN)

(73) Assignee: Yiwu Andong Electrical Appliances Co., Ltd., Yiwu (CN)

( * ) Notice: Subject to any disclaimer, the term of this patent is extended or adjusted under 35 U.S.C. 154(b) by 0 days.

(21) Appl. No.: 12/975,023

(22) Filed: Dec. 21, 2010

(65) Prior Publication Data

US 2011/0088297 A1 Apr. 21, 2011

Related U.S. Application Data

(63) Continuation of application No. PCT/CN2009/000036, filed on Jan. 12, 2009.

(30) Foreign Application Priority Data

Jun. 18, 2008 (CN) ..... 2008 1 0062539

(51) Int. Cl.
*G09F 19/00* (2006.01)

(52) U.S. Cl. ..... 40/428

(58) Field of Classification Search ..... 40/428
See application file for complete search history.

(56) References Cited

U.S. PATENT DOCUMENTS

| | | | | |
|---|---|---|---|---|
| 7,373,743 | B1 * | 5/2008 | Hess | 40/428 |
| 2003/0126775 | A1 * | 7/2003 | Corry et al. | 40/428 |
| 2005/0086841 | A1 | 4/2005 | Schroeter et al. | |
| 2007/0107280 | A1 * | 5/2007 | Stinson et al. | 40/428 |
| 2008/0138050 | A1 * | 6/2008 | Moreland et al. | 392/348 |
| 2009/0126241 | A1 * | 5/2009 | Asofsky | 40/428 |

FOREIGN PATENT DOCUMENTS

| | | |
|---|---|---|
| CN | 1292076 | 4/2001 |
| CN | 1410703 | 4/2003 |
| CN | 1776777 | 5/2006 |
| CN | 101338916 | 1/2009 |

* cited by examiner

*Primary Examiner* — Gary Hoge
(74) *Attorney, Agent, or Firm* — Leason Ellis LLP

(57) ABSTRACT

An electric multiplayer frame fireplace with an internal charcoal bed and an external charcoal bed comprises a housing, an imaging light source arranged on the lower side of the housing, a light processing device and simulated charcoal beds arranged above the imaging light source and an imaging screen, the imaging screen is arranged close to the simulated charcoal beds, a front simulated charcoal bed is arranged on the front side of the lower end of the imaging screen, and a rear simulated charcoal bed higher than the front simulated charcoal bed is arranged on the rear side of the lower end of the imaging screen. In addition, the electric fireplace can simulate the sound of charcoal combustion.

16 Claims, 2 Drawing Sheets

ELECTRIC FRAME FIREPLACE WITH AN INTERNAL CHARCOAL BED AND AN EXTERNAL CHARCOAL BED

CROSS-REFERENCE TO RELATED APPLICATIONS

This application claims priority to and is a continuation of PCT Application PCT/CN2009/000036, filed Jan. 12, 2009 and claims priority from Chinese Patent Application CN200810062539.4 filed on Jun. 16, 2008, both of which are herein incorporated by reference in their respective entireties.

TECHNICAL FIELD OF THE INVENTION

The invention relates to a simulated fireplace, and in particular, to an electric multiplayer frame fireplace with an internal charcoal bed and an external charcoal bed which is more realistic in visual effect and sound effect.

BACKGROUND OF THE INVENTION

In existing simulated fireplaces, electronic flame or simulated flame is often used in a flame simulator to provide the fireplace an optical visual effect and to play a role in decoration. The flame simulators of the fireplaces are generally divided into the following two types: in the first type, a group of ribbons are suspended above a simulated comburent and disposed behind a semi-transparent plastic screen and a mirror glass, and the ribbons are blown by air and projected onto the glass surface to produce flicking lights to simulate burning flame, and this structure is adopted in the patent electric fireplace heater disclosed on May 11, 2005 with a public number of CN2699165; in the second type, a rotary movable motor-driven light source is installed behind a simulated branch-shaped charcoal combustion medium, a flame-shaped wall, a light-transmitting screen and a mirror glass are arranged in front of the light source, the movable light source drives the blades of the rotating shaft of the light source or a light-transmitting screen of a hollow cylinder, the lights reflected by the light source or emitted by the light-transmitting hole on a light-transmitting cover pass through the flame holes on the flame-shaped wall, then a flame shape is generated, the flame shape is projected onto the light-transmitting screen and the mirror glass to simulate flame in visual effect, and this structure is adopted in the patent flame simulator of electric heater disclosed on Dec. 19, 2001 with an application number of CN1327138. The two types of devices can both simulate the visual effect of flame and, at the same time, have the following disadvantages: on one hand, the simulated flame is displayed on the imaging screen in a manner of projection while its visual effect is presented behind the simulated charcoal, lacking visual depth, sense of hierarchy and stereoscopic impression; on the other hand, the simulation effect is not so realistic for the sound of charcoal combustion is not taken into consideration and the brightness of the simulated charcoal is unchanged.

SUMMARY OF THE INVENTION

In order to solve the problem that the flame of existing simulated fireplaces is lacked in visual depth and stereoscopic impression, the invention provides, in a broad aspect, an electric multiplayer frame fireplace with an internal charcoal bed and an external charcoal bed which is more realistic in visual depth, sense of hierarchy and stereoscopic impression.

As the sound of charcoal combustion is not taken into consideration in the simulation of charcoal combustion, and the simulated flame is unchanged in brightness, the simulation effect of existing simulated fireplaces is not so realistic. In order to solve such problem, the invention provides a sounding electric multiplayer frame fireplace with an internal charcoal bed and an external charcoal bed which has a changing combustion brightness and is therefore more realistic.

In order to realize the technical scheme above, the invention adopts the following technical solution: the electric multiplayer frame fireplace with an internal charcoal bed and an external charcoal bed comprises a housing, an imaging light source arranged on the lower side of the housing, a light processing device and simulated charcoal beds arranged above the imaging light source, and an imaging screen close to the simulated charcoal beds, a front simulated charcoal bed is arranged on the front side of the lower end of the imaging screen, and a rear simulated charcoal bed higher than the front simulated charcoal bed is arranged on the rear side of the lower end of the imaging screen. The imaging screen has an irregular rough surface or matte surface, and the imaging lights projected by the light processing device forms visible simulated flame under the action of the rough surface or matte surface which is fully covered with irregular protrusions. The simulated charcoal beds are arranged on the front and the rear sides adjacent to the lower end of the imaging screen, and the rear simulated charcoal bed is higher than the front simulated charcoal bed, therefore, besides the front simulated charcoal bed seen from the front side, the user can further see the charcoal bed behind the imaging screen under the irradiation of the imaging light source, and in combination with the simulated flame produced above the simulated charcoal beds, a vivid burning fireplace with visual depth, sense of hierarchy and stereoscopic impression is presented.

As a preference, the simulated charcoal bed is a semi-transparent strip structure having a simulated charcoal surface on the front upper part and a hollow rear lower part, the charcoal surfaces on the cross sections of the front simulated charcoal bed and the rear simulated charcoal bed are substantially cambered surfaces, and the cambered surface of the front simulated charcoal bed is connected with that of the rear simulated charcoal bed, which accords with the structural feature of a real fireplace that charcoal flame generally has a high middle portion and a low peripheral portion and that the surface of the charcoal flame is arc-shaped, thus, the generated simulation effect is more realistic.

As a preference, the imaging screen is a semi-transparent flake structure with two matte surfaces, and the front vertical side of the rear simulated charcoal bed and the rear vertical side of the front simulated charcoal bed are tightly clung to the imaging screen. The imaging screen with such a structure makes the objects nearby the imaging screen clear and those away from the imaging screen blurry; the front vertical side of the rear simulated charcoal bed is tightly adhered to the imaging screen and the charcoal surface on the cross section of the rear simulated charcoal bed is substantially an cambered surface with a lower front part and a higher rear part, therefore, the image of the charcoal surface nearby the front vertical side of the rear simulated charcoal bed close to the imaging screen on the imaging screen is clear, while the image of the charcoal surface away from the rear high position of the imaging screen on the imaging screen is blurry; moreover, the charcoal surface is gradually blurred, which accords with the real situation that the front part of charcoal flame is seen clearly while the rear part is seen vaguely, as a consequence, the simulation of the charcoal flame of the electric fireplace is more realistic.

As a preference, multiple light-transmitting grooves are arranged on the front vertical side of the rear simulated charcoal bed, lights cam be emitted from the light-transmitting grooves under the irradiation of the imaging light source; and multiple bright light-emitting points can be simulated on the fireplace after the lights reach the imaging screen, which improves the simulation effect of the whole electric multiplayer frame fireplace and makes the simulated combustion of the charcoal beds more realistic, and at the same time, the visual depth effect and sense of hierarchy of the front and the rear simulated charcoal beds is enhanced.

As a preference, multiple irregularly-distributed gaps are arranged on the tops of the front simulated charcoal bed and the rear simulated charcoal bed, according with the charcoal block distribution situation of a real fireplace, and making the simulated charcoal more realistic.

As a preference, the light processing device is a light reflector, which is composed of a motor-driven rotating shaft and flexible light reflecting strips arranged on the light reflector and is disposed behind the rear simulated charcoal bed. One end of the flexible light reflecting strips is suspended, and the other end is fixed on a rotating shaft; and the length of the flexible light reflecting strips is greater than the distance between the rotating shaft and the rear simulated charcoal bed or the back wall of the housing of the electric fireplace, consequentially, the flexible light reflecting strips in rotation touch the back wall of the housing of the electric fireplace to produce irregular flickers, and the lights of the imaging light source reflected by the light reflecting strips on the rotating shaft is provided with a bottom-to-top movement track with a great fluctuation on the imaging screen to present a changing dynamic flame with great fluctuation. On the other hand, the touch of the flexible light reflecting strips with the rear simulated charcoal bed or the back wall of the housing of the electric fireplace will make a sound resembling the combustion of charcoal, so the electric fireplace simulates a real fireplace in both visual effect and sound effect, and the user truly feels the existence of the fireplace.

As a preference, a remote control circuit for the imaging light source is arranged in the housing to control the brightness change of the imaging light source following a preset program set by a remote controller. Existing simulated electric fireplaces are not so realistic for the combustion intensity of a real fireplace changes as times goes on, while existing simulated electric fireplaces has only one combustion intensity, that is, there is almost no change in the brightness of the flame of existing simulated electric fireplaces in the whole use process. For this sake, a remote control circuit for the imaging light source is arranged in the housing to control the brightness change of the imaging light source following a preset program set by a remote controller, and then the brightness change in the combustion of a real fireplace can be completely simulated to realize an optimal simulation effect. Meanwhile, for the control on the brightness of the imaging light source is realized by a remote controller, the user is freed and the operation is very convenient.

The invention is advantaged in effectively solving the problem that existing simulated fireplaces are not so realistic for the simulated flame is lacked in the visual depth, sense of hierarchy and stereoscopic impression and the sound of charcoal combustion is not taken into consideration in the simulation of charcoal combustion. In addition, the invention is capable of, with simple structure, simulating the combustion of charcoal both in appearance and sound and changing the combustion brightness of charcoal to present a more realistic simulation effect.

DESCRIPTION OF THE DRAWING FIGURES

DETAILED DESCRIPTION OF CERTAIN EMBODIMENTS OF THE INVENTION

Several specific implementations of the technical solution of the invention are described below in detail by referring to the following embodiments in conjunction with the figures attached; however, the broad aspects of the invention can be appreciated from the summary above and the claims appended hereto.

Embodiment 1

Figure 1:
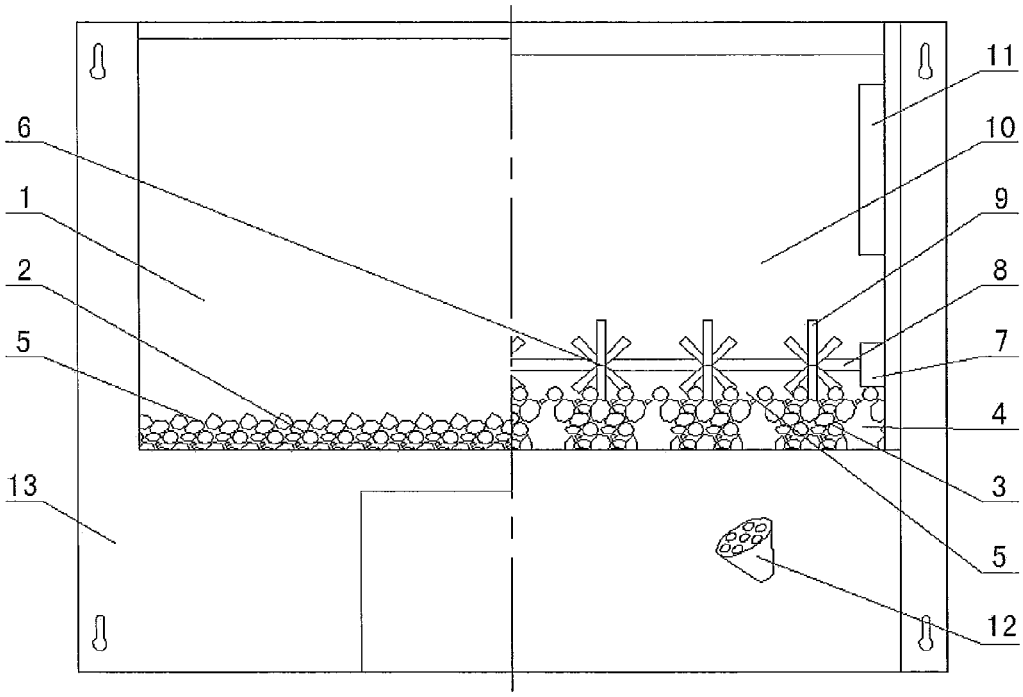
FIG. 1 is a structural diagram of the electric multiplayer frame fireplace with an internal charcoal bed and an external charcoal bed.
Figure 2:
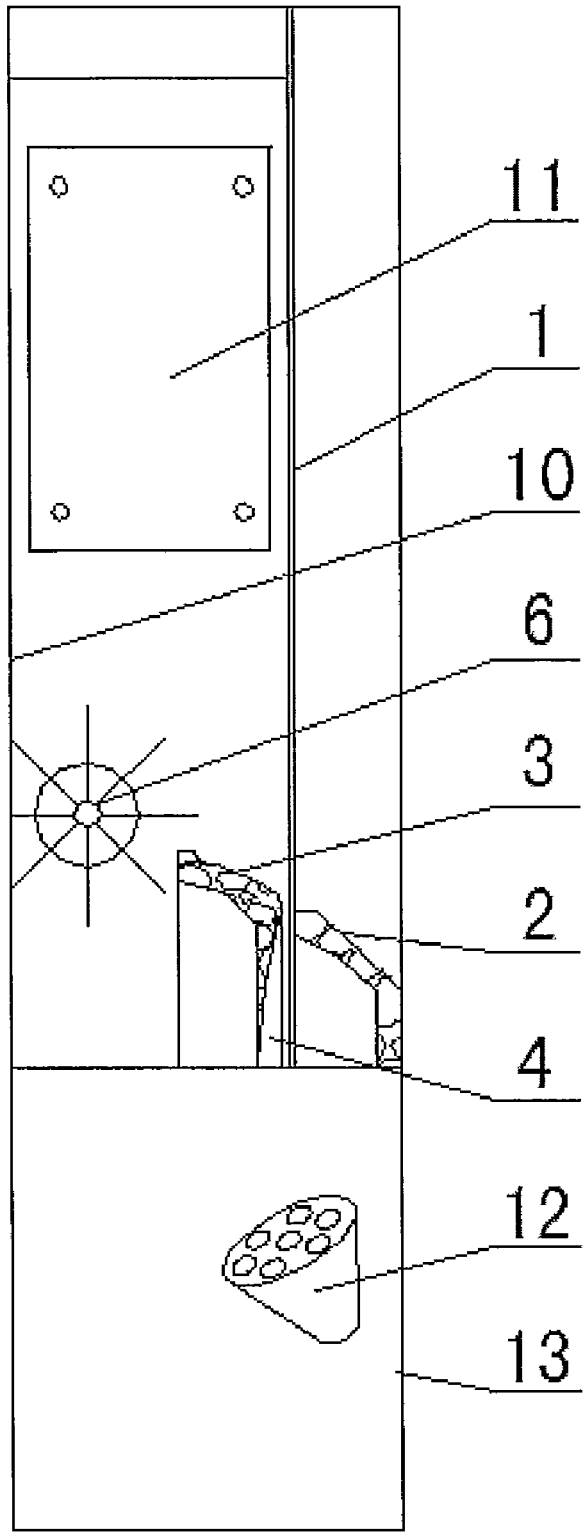
FIG. 2 is the left view of the FIG. 1.

In the embodiment shown in FIG. 1 and FIG. 2, the electric multiplayer frame fireplace with an internal charcoal bed and an external charcoal bed comprises a housing 13, an imaging light source 12 arranged on the lower side of the housing 13, a light processing device 6 and simulated charcoal beds arranged above the imaging light source 12, and an imaging screen 1 close to the simulated charcoal beds; the light processing device 6 is a light reflector, which is composed of a rotating shaft 8 driven by a motor 7 and flexible light reflecting strips 9 arranged on the rotating shaft 8; one end of the flexible light reflecting strips 9 is suspended, and the other end is fixed on the rotating shaft 8; and the length of the flexible light reflecting strips 9 is greater than the distance between the rotating shaft 8 and the rear simulated charcoal bed 3 or the back wall 10 of the housing of the electric fireplace, and the light processing device 6 is arranged behind a rear simulated charcoal bed 3. The imaging screen 1 is a semi-transparent strip structure having an irregular rough surface or matte surface, and the imaging lights projected by the light processing device 6 form visible simulated flame under the action of the rough surface or matte surface which is fully covered with irregular protrusions. A front simulated charcoal bed 2 is arranged on the front side of the lower end of the imaging screen 1, the rear simulated charcoal bed 3 higher than the front simulated charcoal bed 2 is arranged on the rear side of the lower end of the imaging screen 1, and the front vertical side of the rear simulated charcoal bed 3 and the rear vertical side of the front simulated charcoal bed 2 are tightly adhered to the imaging screen 1. The simulated charcoal bed is a semi-transparent strip structure having a simulated charcoal surface on the front upper part and a hollow rear lower part, the charcoal surfaces on the cross sections of each of the front simulated charcoal bed 2 and the rear simulated charcoal bed 3 are substantially cambered surfaces, and the cambered surface of the front simulated charcoal bed 2 is connected with that of the rear simulated charcoal bed 3; multiple irregularly-distributed gaps 5 are arranged on the tops of the front simulated charcoal bed 2 and the rear simulated charcoal bed 3; and multiple light-transmitting grooves 4 are arranged on the front vertical side of the rear simulated charcoal bed 3. A remote control circuit 11 for the imaging light source is arranged in the housing to control the brightness change of the imaging light source 12 following a preset program set by a remote controller. Additionally, the inner wall of the housing of the electric fireplace is painted to be black to absorb lights to prevent the diffuse reflection of lights from degrading the visual effect of the fireplace.

When in use, part of the lights emitted from the imaging light source are directly irradiated onto the front and the rear simulated charcoal beds; as the front and the rear simulated charcoal beds are both semi-transparent structures and the charcoal surfaces of the front and the rear simulated charcoal beds are colored, the charcoal beds present the color of burning charcoal under the irradiation of the lights; meanwhile, there are an internal charcoal bed and an external charcoal bed, and the rear simulated charcoal bed is arranged behind the semi-transparent imaging screen and is higher than the front simulated charcoal bed, seen from the front side, the front simulated charcoal bed presents the bright color of charcoal flame while the rear simulated charcoal bed presents the color of distant charcoal flame, therefore, the charcoal flame in the fireplace has a visual depth, a sense of hierarchy and a stereoscopic impression and looks more real. The lights transmitted from the light-transmitting grooves on the front vertical side of the rear simulated charcoal bed and the irregular gaps on the tops of the front and the rear charcoal beds accord with the actual distribution situation of charcoal blocks in a real fireplace, making the visual effect of the simulated charcoal combustion more realistic. After the electric fireplace starts to work, the motor rotates to drive the rotating shaft to rotate, then the flexible light reflecting strips on the rotating shaft rotate along with the rotating shaft, part of the lights from the imaging light source are reflected onto the imaging screen by the flexible light reflecting strips to form a bottom-to-top flame effect on the imaging screen. As the length of the flexible light reflecting strips is greater than the distance between the rotating shaft and the rear simulated charcoal bed or the back wall of the housing of the electric fireplace, the flexible light reflecting strips in rotation will touch the rear simulated charcoal bed or the back wall of the housing of the electric fireplace to produce unexpected irregular upward flickers, and the lights of the imaging light source reflected by the light reflecting strips on the rotating shaft is provided with a light movement track with great fluctuation on the imaging screen to present a changing dynamic flame with great fluctuation. The brightness change of the imaging light source 12 is controlled by the remote control circuit 11 through the program set by the remote controller to fully simulate the natural brightness change in the combustion of a real fireplace to realize the optimal simulation effect. On the other hand, the touch of the flexible light reflecting strips with the rear simulated charcoal bed or the back wall of the housing of the electric fireplace will make a sound resembling the combustion of charcoal, so the electric fireplace simulates a real fireplace in both visual effect and sound effect, and the user can truly feel the existence of the fireplace.

I claim:

1. An electric frame fireplace having an internal charcoal bed and an external charcoal bed, comprising:

a housing;

an imaging light source arranged on the lower side of the housing;

a light processing device and a front and a rear simulated charcoal bed arranged above the imaging light source; and an imaging screen close to the simulated charcoal beds and having a lower end, wherein the front simulated charcoal bed is arranged on a front side of the lower end of the imaging screen, and the rear simulated charcoal bed is arranged higher than the front simulated charcoal bed on the rear side of the lower end of the imaging screen, wherein the imaging screen has an irregular rough surface or matte surface, and wherein the front vertical side of the rear simulated charcoal bed and the rear vertical side of the front simulated charcoal bed are tightly adhered to the imaging screen.

2. The electric frame fireplace as in claim 1, wherein multiple irregularly-distributed gaps are arranged on the tops of the front simulated charcoal bed and the rear simulated charcoal bed.

3. The electric frame fireplace as in claim 1, wherein the light processing device is a light reflector, which is composed of a rotating shaft driven by a motor and flexible light reflecting strips arranged on the rotating shaft and is disposed behind the rear simulated charcoal bed.

4. The electric frame fireplace as in claim 1, wherein a remote control circuit for the imaging light source is arranged in the housing to control the brightness change of the imaging light source according to a program set by a remote controller.

5. An electric frame fireplace having an internal charcoal bed and an external charcoal bed, comprising:

a housing;

an imaging light source arranged on the lower side of the housing;

a light processing device and a front and a rear simulated charcoal bed arranged above the imaging light source; and an imaging screen close to the simulated charcoal beds and having a lower end, wherein the front simulated charcoal bed is arranged on a front side of the lower end of the imaging screen, and the rear simulated charcoal bed is arranged higher than the front simulated charcoal bed on the rear side of the lower end of the imaging screen, wherein multiple light-transmitting grooves are arranged on the front vertical side of the rear simulated charcoal bed.

6. The electric frame fireplace as in claim 5, wherein multiple irregularly-distributed gaps are arranged on the tops of the front simulated charcoal bed and the rear simulated charcoal bed.

7. The electric frame fireplace as in claim 5, wherein the light processing device is a light reflector, which is composed of a rotating shaft driven by a motor and flexible light reflecting strips arranged on the rotating shaft and is disposed behind the rear simulated charcoal bed.

8. The electric frame fireplace as in claim 5, wherein a remote control circuit for the imaging light source is arranged in the housing to control the brightness change of the imaging light source according to a program set by a remote controller.

9. The electric frame fireplace as in claim 5, wherein the imaging screen has an irregular rough surface or matte surface, and wherein the front vertical side of the rear simulated charcoal bed and the rear vertical side of the front simulated charcoal bed are tightly adhered to the imaging screen.

10. The electric frame fireplace as in claim 5, wherein the light processing device is a light reflector, which is composed of a rotating shaft driven by a motor and flexible light reflecting strips arranged on the rotating shaft and is disposed behind the rear simulated charcoal bed.

11. An electric frame fireplace having an internal charcoal bed and an external charcoal bed, comprising:

a housing;

an imaging light source arranged on the lower side of the housing;

a light processing device and a front and a rear simulated charcoal bed arranged above the imaging light source; and an imaging screen close to the simulated charcoal beds and having a lower end, wherein the front simulated charcoal bed is arranged on a front side of the lower end of the imaging screen, and the rear simulated charcoal bed is arranged higher than the front simulated charcoal bed on the rear side of the lower end of the imaging screen, wherein the light processing device is a light reflector, which is composed of a rotating shaft driven by a motor and flexible light reflecting strips arranged on the rotating shaft and is disposed behind the rear simulated charcoal bed, and wherein one end of the flexible light reflecting strips is suspended, and the other end thereof is fixed on the rotating shaft; and the length of the flexible light reflecting strips is greater than the distance between the rotating shaft and the rear simulated charcoal bed or the back wall of the housing of the electric fireplace.

12. The electric frame fireplace as in claim 11, wherein multiple irregularly-distributed gaps are arranged on the tops of the front simulated charcoal bed and the rear simulated charcoal bed.

13. The electric frame fireplace as in claim 11, wherein the light processing device is a light reflector, which is composed of a rotating shaft driven by a motor and flexible light reflecting strips arranged on the rotating shaft and is disposed behind the rear simulated charcoal bed.

14. The electric frame fireplace as in claim 11, wherein a remote control circuit for the imaging light source is arranged in the housing to control the brightness change of the imaging light source according to a program set by a remote controller.

15. The electric frame fireplace as in claim 11, wherein the imaging screen has an irregular rough surface or matte surface, and wherein the front vertical side of the rear simulated charcoal bed and the rear vertical side of the front simulated charcoal bed are tightly adhered to the imaging screen.

16. The electric frame fireplace as in claim 11, wherein multiple light-transmitting grooves are arranged on the front vertical side of the rear simulated charcoal bed.

* * * * *